US007562801B2

(12) United States Patent
Pelletier et al.

(10) Patent No.: US 7,562,801 B2
(45) Date of Patent: Jul. 21, 2009

(54) STAPLER WITH GUIDE

(75) Inventors: Thomas Pelletier, Wallingford, CT (US); Timothy Lebeau, Avon, CT (US); Russell H Powers, Newington, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 11/207,719

(22) Filed: Aug. 22, 2005

(65) Prior Publication Data

US 2007/0039994 A1 Feb. 22, 2007

(51) Int. Cl.
*B25C 5/02* (2006.01)

(52) U.S. Cl. ..... 227/156; 227/119; 227/132; 227/152

(58) Field of Classification Search ..... 227/109, 227/110, 156, 120, 132, 119, 150, 152, 26, 227/30, 29
See application file for complete search history.

(56) References Cited

U.S. PATENT DOCUMENTS 2,137,642 A * 11/1938 Cavanagh ..... 227/132
2,285,512 A 6/1942 Harley
2,314,847 A 3/1943 Polzer
2,314,848 A 3/1943 Polzer
2,342,818 A 2/1944 Polzer
2,618,779 A 11/1952 Byard
2,637,030 A 5/1953 Wickman et al.
2,668,290 A 2/1954 Heller
2,746,043 A 5/1956 Heller
2,746,044 A 5/1956 Cusumano et al.
2,754,515 A 7/1956 King
2,775,763 A 1/1957 Flammer
3,510,043 A * 5/1970 Larson ..... 227/113
3,860,161 A 1/1975 Engstrom et al.
4,087,035 A 5/1978 Harmon
4,119,258 A 10/1978 Ewig, Jr.
4,155,498 A 5/1979 Ewig
4,184,620 A * 1/1980 Ewig ..... 227/8
4,202,481 A 5/1980 Yanagida et al.
4,450,998 A 5/1984 Ruskin
D280,069 S 8/1985 Hillinger
4,552,296 A * 11/1985 Sheng ..... 227/109

(Continued)

FOREIGN PATENT DOCUMENTS

EP 0698448 A1 2/1996

(Continued)

*Primary Examiner*—Rinaldi I. Rada
*Assistant Examiner*—Nathaniel Chukwurah
(74) *Attorney, Agent, or Firm*—Pillsbury Winthrop Shaw Pittman LLP

(57) ABSTRACT

A stapler includes a housing having a hand grip portion constructed and arranged to be manually grasped by an operator, a staple drive track disposed in the housing, a staple feed track leading to the staple drive track configured to guide staples toward the drive track, and a staple driver mounted within the staple drive track, the staple driver configured to drive staples into a workpiece. The stapler further includes a guide pivotally mounted in a body portion of the housing. The guide has an elongated member receiving region. The guide is configured to pivot between a stored position in which the guide is disposed within the housing and a deployed position in which the guide extends out of the housing.

17 Claims, 4 Drawing Sheets

U.S. PATENT DOCUMENTS

| | | | | |
|---|---|---|---|---|
| 4,801,061 | A | 1/1989 | Mangone, Jr. | |
| 4,805,824 | A | 2/1989 | Erickson | |
| 5,094,380 | A | 3/1992 | Nasiatka | |
| 5,234,147 | A * | 8/1993 | Greenwalt | 227/149 |
| D349,439 | S | 8/1994 | Chou | |
| 5,350,267 | A | 9/1994 | Mangone, Jr. | |
| D384,257 | S | 9/1997 | Marks et al. | |
| D384,258 | S | 9/1997 | Marks et al. | |
| 5,735,444 | A | 4/1998 | Wingert | |
| 5,884,829 | A | 3/1999 | Wingert | |
| 5,931,364 | A * | 8/1999 | Dennis | 227/109 |
| D415,668 | S | 10/1999 | Elie | |
| D419,411 | S | 1/2000 | Elie | |
| 6,082,604 | A | 7/2000 | Dennis | |
| 6,131,788 | A * | 10/2000 | Marks | 227/132 |
| 6,179,192 | B1 | 1/2001 | Weinger | |
| 6,554,173 | B1 | 4/2003 | Currie | |
| 6,634,537 | B2 | 10/2003 | Chen | |
| 6,698,642 | B2 | 3/2004 | Chen | |
| 2002/0108996 | A1 | 8/2002 | Cornett et al. | |
| 2003/0038153 | A1 | 2/2003 | Chen | |

FOREIGN PATENT DOCUMENTS

| | | | |
|---|---|---|---|
| EP | 1327500 | A2 | 7/2003 |

* cited by examiner

STAPLER WITH GUIDE

BACKGROUND OF THE INVENTION

1. Field of the Invention

The present invention pertains to fastener driving tools.

2. Discussion of Related Art

Staplers are commonly used as tools for fastening paper, cardboard, fabric or other sheets of material to other similar sheets of material or to a substrate such as wood, plastic or the like. In other applications, staplers are used to attach elongated members, such as electrical wires, cables or tubes onto a substrate such as wood or other materials.

For example, it is common to tack electrical wires onto a workpiece or surface, such as a wall, a floor, a baseboard, or a wooden surface during the installation of electrical or electronic equipment. Conventional staplers may be used to tack a wire. However, conventional staplers eject a metal staple and in some instances a pointed edge of the staple may penetrate or lacerate the insulation of the wire or in other instances the metal bar of the stapler may crimp or cut through the cladding insulation of the conducting wire and as a result may damage the electrical characteristics of the conducting wire.

Other staplers exist that are directed to the application of tacking wire. Wire staplers resemble conventional staplers in many aspects, but some may be provided with an additional feature. Specifically, a notched extension may be provided towards the front end of a nose or body portion of the stapler, adjacent to the position at which a staple exits the stapler. The notched extension straddles the wire or elongated member so as to position the stapler relative to the elongated member and thus ensure that the staples points do not penetrate and thus damage the elongated member. In some instances, the guide may also be used to prevent the staples from seating flush on a surface, thus reducing the likelihood of cramping the wire during the operation of tacking.

For example, U.S. Pat. Nos. 6,131,788 and 5,884,829 disclose such types of staplers. However, such patents disclose relatively complex guide structures. For example, the '788 patent requires a wire guide to be slidably fitted within a slot, with the wire guide being movable vertically between an upper vertical position and a lower vertical position. The '829 patent discloses an equally complex structure.

BRIEF SUMMARY OF THE INVENTION

An aspect of the present invention is to provide a stapler including a housing having a hand grip portion constructed and arranged to be manually grasped by an operator, a staple drive track disposed in the housing, a staple feed track leading to the staple drive track configured to guide staples toward the drive track, and a staple driver mounted within the staple drive track, the staple driver configured to drive staples into a workpiece. The stapler further includes a guide pivotally mounted in a body portion of the housing. The guide has an elongated member receiving region. The guide is configured to pivot between a stored position in which the guide is disposed within the housing and a deployed position in which the guide extends out of the housing.

Another aspect of the present invention is to provide a stapler including a housing having a hand grip portion constructed and arranged to be manually grasped by an operator, a staple drive track disposed in the housing, a staple feed track leading to the staple drive track configured to guide staples toward the drive track, a staple driver mounted within the staple drive track, the staple driver configured to drive staples into a workpiece. The stapler further includes a trigger lever pivotally mounted to the housing for firing the stapler. The hand grip portion and the trigger lever comprise a resilient material adapted to facilitate handling of the stapler.

Yet another aspect of the present invention is to provide a stapler including a housing having a hand grip portion constructed and arranged to be manually grasped by an operator, a staple drive track disposed in the housing, a staple feed track leading to the staple drive track configured to guide staples toward the drive track, a staple driver mounted within the staple drive track, the staple driver configured to drive staples into a workpiece. The stapler further includes a trigger lever pivotally mounted to a body portion of said housing for firing said stapler. The body portion includes a cap portion configured to be held by an operator during operation of the stapler. The hand grip portion and the cap portion comprise a resilient material adapted to facilitate handling of the stapler.

These and other aspects of the invention will become apparent when taken with the detailed description and drawings.

DETAILED DESCRIPTION OF PREFERRED EMBODIMENTS OF THE INVENTION

Figure 1A:
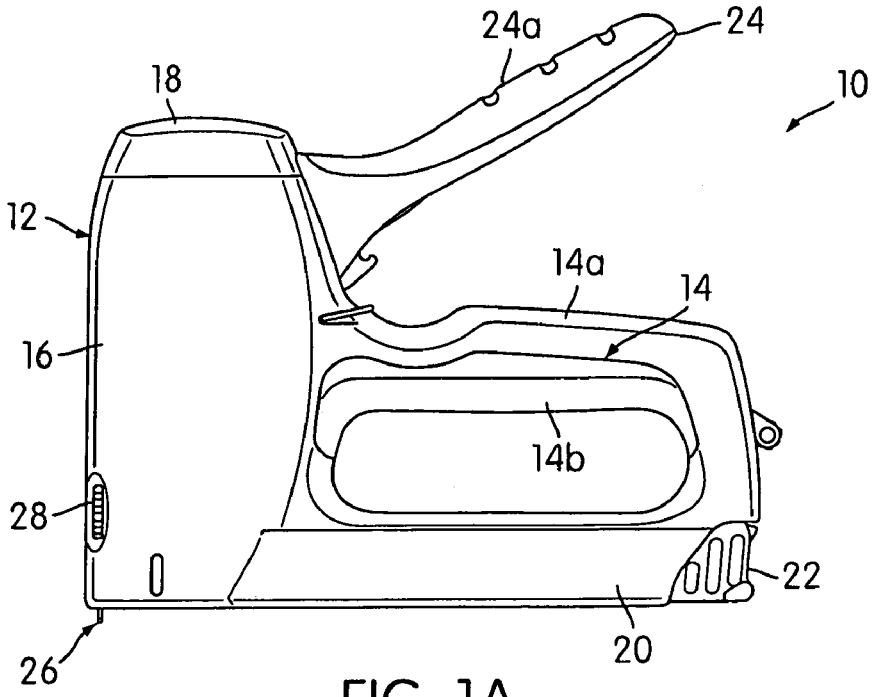
FIG. 1A is a side elevational view of a stapler according to an embodiment of the present invention.
Figure 1B:
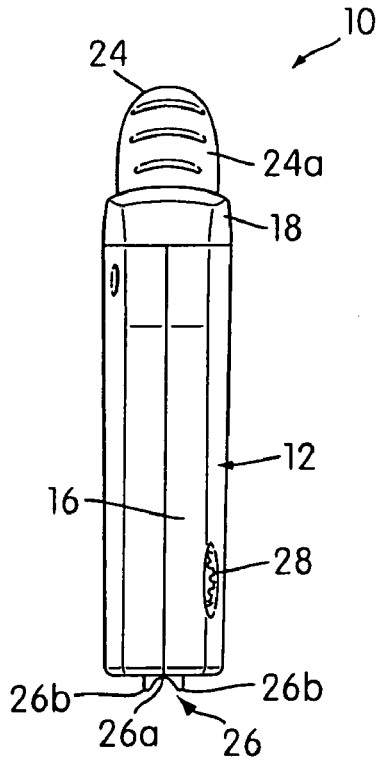
FIG. 1B is a front elevational view of a stapler according to an embodiment of the present invention.

FIGS. 1A and 1B are, respectively, a side elevational view and a front elevational view of a stapler according to an embodiment of the present invention. Stapler 10 includes a housing 12. The housing 12 can be made of any suitable material, such as, but not limited to, metal and plastic. The housing 12 includes a hand grip portion 14 constructed and arranged to be manually grasped by an operator. The hand grip portion 14 includes an exterior portion 14*a* and interior portion 14*b*. In an embodiment of the invention, the interior portion 14*b* is provided with an insert or cover made of a resilient material such as a soft rubber, a soft plastic or other suitable material to provide a cushion to user's fingers. In this way the user can handle the stapler with a more comfortable grip. In another embodiment, both portions 14*a* and 14*b* are provided with an insert or cover made of resilient material to provide a more comfortable grip.

The housing 12 further includes a body portion 16 configured to house, among other things, a staple drive track (not shown). The body portion of the housing includes a cap portion 18 configured to be held by a user during operation of the stapler 10. In an embodiment of the invention, the cap portion 18 is made of a resilient material or otherwise covered by a resilient material. The resilient material can be, for example, a soft rubber or a soft plastic. The resilient material provides a better grip to the user. In addition, the resilient material on the cap portion 18 provides more comfort to a hand of the user when the user applies a force during operation of the stapler to drive a staple into a workpiece and substantially block the stapler from recoiling.

The stapler 10 further includes a feed track 20 leading to the staple drive track in the body portion 16. A track pull 22 operates the feed track 20 to load fasteners into the feed track 20. The feed track 20 is configured to guide staples toward the drive track by biasing the staples toward an opening in the housing through which staples can be expelled.

The stapler 10 further includes a lever 24 pivotally mounted to the body portion 16 of the housing 12. In an embodiment of the invention, the lever 24 is provided with a resilient material such as a soft rubber or a soft plastic. In an embodiment of the invention, the resilient material covers at least a portion 24*a* of the lever 24 on which a user's hand rests. This provides the user more grip on the lever as well as provide more comfort when manipulating the lever 24.

Figure 2A:
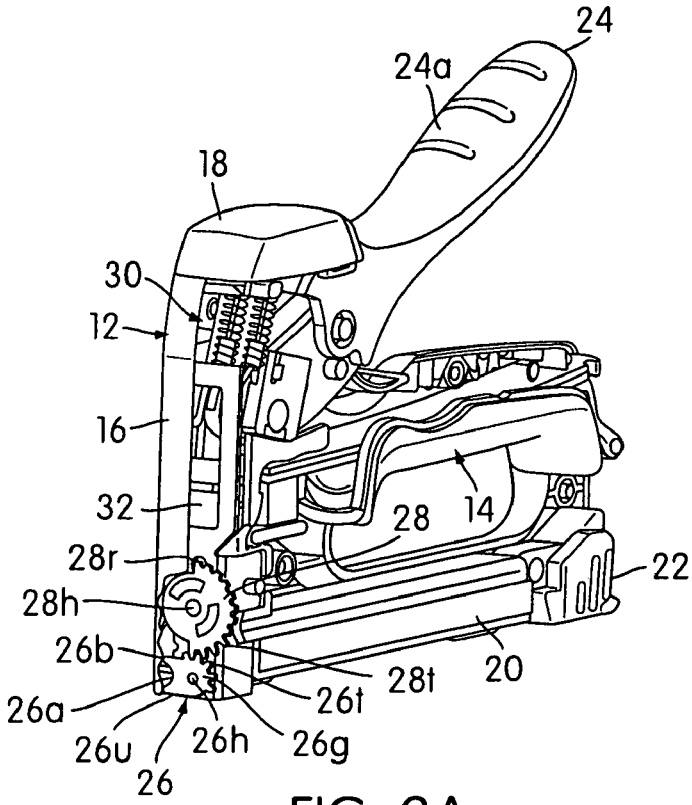
FIG. 2A is a three-dimensional cut-through view of a stapler according to an embodiment of the invention.
Figure 2B:
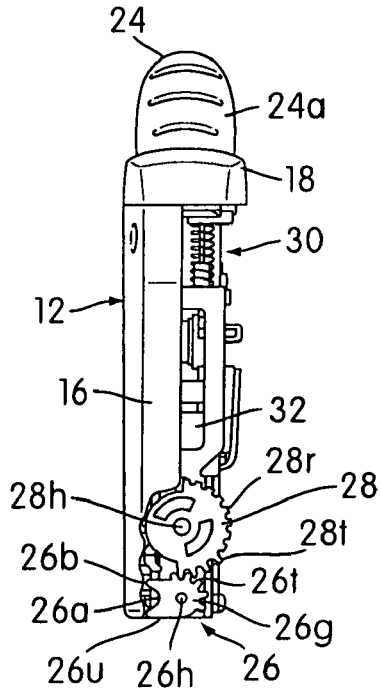
FIG. 2B is a front elevational cut-through view of a stapler according to an embodiment of the invention.
Figure 3A:
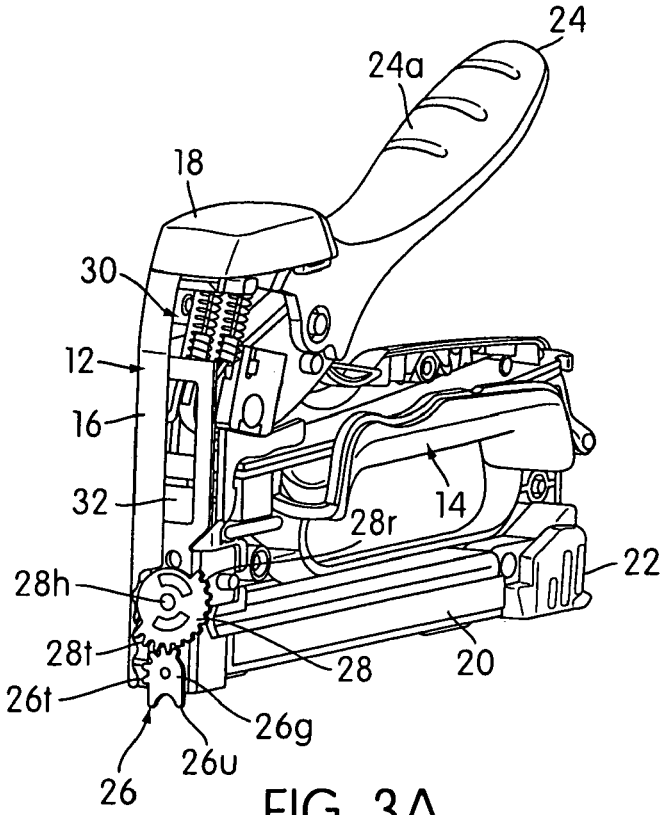
FIG. 3A is a three-dimensional cut-through view of a stapler according to an embodiment of the invention.
Figure 3B:
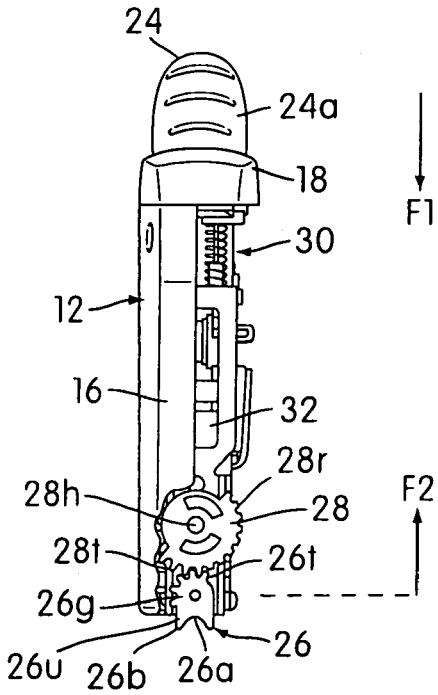
FIG. 3B is a front elevational cut-through view of the stapler 10 according to an embodiment of the invention.

FIGS. 2A and 3A are a three-dimensional cut-through view of the stapler 10 according to an embodiment of the invention and FIGS. 2B and 3B are a front elevational cut-through view of the stapler 10 according to an embodiment of the invention. Specifically, FIGS. 2A, 2B, 3A and 3B show some of the inner structure of the stapler 10 according to an embodiment of the invention. The stapler 10 includes a driving mechanism 30 disposed inside the body portion 16 of housing 12. In an embodiment of the invention, the driving mechanism 30 is a conventional driving mechanism. The driving mechanism 30 includes driving element 32, for example a driving knife. The driving mechanism 30 is operably connected to lever 24. The lever 24, when squeezed in a conventional manner by pressing the lever 24 towards the handle 14, operates the driving mechanism 30 inside the body portion 16 of housing 12 to power and fire the driving element 32.

The driving element 32 moves in the drive track in the body portion 16 of the housing 12 to engage a staple (not shown in the Figures) in front end of the feed track 20 to expel the staple from the drive track and to drive the staple into a workpiece.

The stapler 10 further includes a guide 26 rotatably mounted in the body portion 16 of the housing 12. The guide 26 has a U-shaped portion 26*u* adapted to straddle a wire to be secured to a workpiece. The guide portion 26*u* has a recess notch 26*a* and lateral elements 26*b*. The recess notch 26*a* provides clearance to the wire and lateral elements 26*b* surround partially the wire to ensure that pointed edges of a staple driven to the workpiece do not damage the wire or cladding of the wire. The guide 26 further includes a gear portion 26*g*. The gear portion 26*g* is semi-disc-shaped and has a plurality of teeth 26*t* disposed around a circumference of the semi-disc.

Figure 4A:
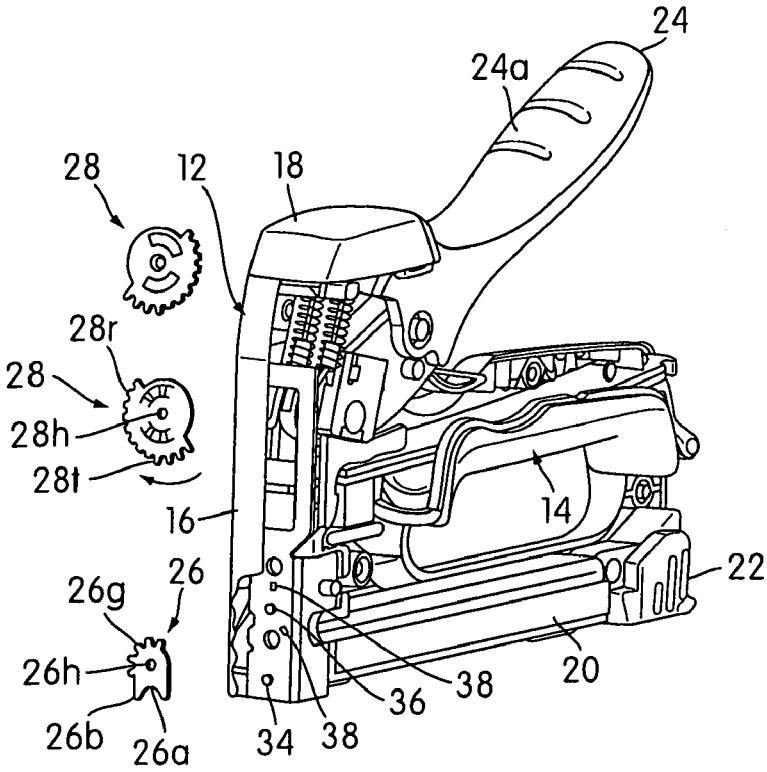
FIG. 4A is a cut-through three-dimensional elevational view of a stapler according to an embodiment of the invention.
Figure 4B:
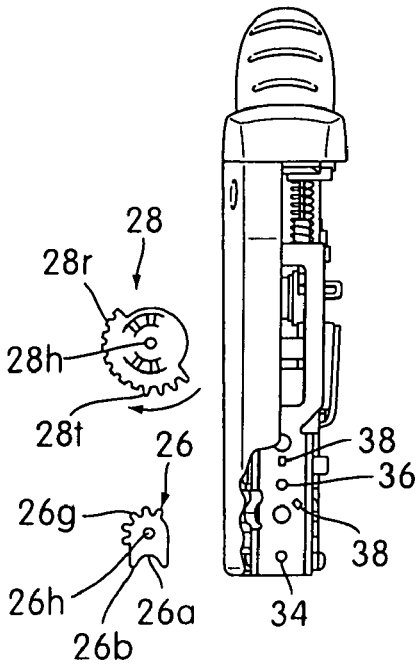
FIG. 4B is a cut-through elevational front view of a stapler according to an embodiment of the invention.

FIGS. 4A and 4B are, respectively, a cut-through elevational front view and a cut-through three-dimensional elevational view of stapler 10 in accordance with an embodiment of the invention. The guide 26 has a hole 26*h* generally located at a center of the gear portion 26*g*. The hole 26*h* is configured to fit in a post or pin 34 (shown in FIGS. 4A and 4B) provided in housing 12 of stapler 10 so as to allow the guide 26 to rotate around an axis defined by the post 34.

The guide 26 is configured to pivot around the post 34 between a retracted position in which the guide 26 is stored hidden within the body portion 16 of the housing 12, as illustrated in FIGS. 2A and 2B, and a deployed position in which the guide 26 extends out of the body portion 16 of housing 12, as illustrated in FIGS. 3A and 3B.

A dial 28 is operatively connected to the guide 26 to rotate the guide 26. In an embodiment of the invention the dial 28 has a disc-like configuration. The dial 28 has a plurality of teeth 28*t* located on a portion of a circumference of the disc and a plurality of ridges 28*r* located on another portion of the circumference of the disc. Similarly to the guide 26, the dial 28 is provided with a hole 28*h* generally located at a center of the disc. The hole 28*h* is configured to fit in a post or pin 36 (shown in FIGS. 4A and 4B) provided in housing 12 of stapler 10 so as to allow the dial 28 to rotate around an axis defined by the post 36. A retaining structure 38 is provided to frictionally contact the dial 28 so as to retain in the deployed position or retracted position. In an embodiment of the invention, the retaining structure includes one or more detents that are biased by a spring or the like to contact the dial 28.

When both the guide 26 and the dial 28 are mounted on, respectively, post 34 and post 36, the teeth 26*t* and teeth 28*t* mate. As a result rotating the dial 28 around the axis defined by post 36 will rotate the guide 26 around the axis defined by the post 34. Thus, by rotating the dial 28, for example clockwise, the guide 26 can be pivoted from a first position in which the U-shaped portion 26*u* of the guide 26 is stored hidden within the body portion 16 of the housing 12, as illustrated in FIGS. 2A and 2B, into a second position in which the U-shaped portion 26*u* of the guide 26 is deployed and extends from the body portion 16 of housing 12, as illustrated in FIGS. 3A and 3B. Vice-versa, by rotating the dial 28, for example counter-clockwise, the guide 26 can be pivoted from the deployed position in which the U-shaped portion 26*u* of the guide 26 extends out of the body portion 16 of housing 12, as illustrated in FIGS. 3A and 3B, into the stored position in which the U-shaped portion 26*u* of the guide 26 is stored hidden within the body portion 16 of the housing 12, as illustrated in FIGS. 2A and 2B. Since a large portion of the dial 28 is enclosed in the body portion 16 of housing 12 and only a portion of the dial is accessible manually by the user, as shown for example in FIGS. 1A and 1B, the plurality of ridges 28*r* on the portion of the circumference of the dial 28 are provided to facilitate rotation of the dial 28 by a user's finger.

When the U-shaped portion 26*u* of the guide 26 is deployed, as illustrated in FIGS. 3A and 3B, the stapler 10 is in a wire-tacking configuration. In this configuration, a staple can be driven into a workpiece and the staple straddle s the wire to tack the wire to the workpiece. On the other hand, when the U-shaped portion 26*u* of the guide 26 is stored within the body portion 16 of housing 12, as illustrated in FIGS. 2A and 2B, the stapler is in a conventional configuration. In this configuration, the staple can be driven into a workpiece to tack a wire into the workpiece. However, as previously stated, an edge of the staple may perforate or lacerate an insulation of the wire or damage the wire itself. Hence, when used in the conventional configuration, the stapler 10 is better suited for other applications, such as tacking a sheet of a material to a workpiece or work surface.

When the U-shaped portion 26*u* of guide 26 is deployed, the recess notch 26*a* of guide 26 is positioned on the wire and a force is applied on the stapler to hold the stapler in place so as to counteract any recoil force that may be generated during driving of the staple into the workpiece. This is performed by holding the stapler 10 by the cap 18 by applying a force F1 (shown by an arrow in FIG. 3B) and pressing the lever 24 to drive a stapler into the workpiece. As a result of applying a force F1, counter-reaction force F2 opposite to F1 (shown in FIG. 3B) is applied on the guide 26 perpendicular to the post 34. The post 34 resists the force being applied. Consequently, the guide 26 does not translate but remains at the same position. This provides improved stability and precision during placement of the guide on top of a wire or during driving of a staple to tack the wire.

Although the guide is shown in the Figures having a U-shape, specifically suited for mating with wires having substantially a circular cross-section, it is also within the scope of the present invention to have various shapes or forms, for example instead of U-shaped guide, another form can be selected to mate with a specific wire cross-section. Furthermore, it must be appreciated that the guide can made from any material, such as, but not limited to, metal and/or impact resistant plastic. The many features of the present invention are apparent from the detailed specification and thus, it is intended by the appended claims to cover all such features of the described stapler which follow the true spirit and scope of the invention.

Furthermore, since numerous modifications and changes will readily occur to those of skill in the art, it is not desired to limit the invention to the exact construction and operation described herein. Accordingly, all suitable modifications and equivalents should be considered as falling within the spirit and scope of the invention.

What is claimed:

1. A stapler comprising:

a housing including a hand grip portion constructed and arranged to be manually grasped by an operator;

a staple drive track disposed in said housing;

a staple feed track leading to said staple drive track configured to guide staples toward said drive track, a staple driver mounted within said staple drive track, said staple driver configured to drive staples into a workpiece; and a guide pivotally mounted in a body portion of said housing, a bottom surface of the body portion being configured to engage the workpiece, the guide having an elongated member receiving region constructed and arranged to receive an elongated member, the elongated member to be secured to the workpiece using said staples driven by the staple driver, and said guide configured to pivot between a stored position in which the guide is stored above the bottom surface of the body portion and within the housing and a deployed position in which the guide projects below the bottom surface of the body portion and out of the housing.

2. A stapler according to claim 1, wherein the guide pivots about a fixed pivot pin, the fixed pivot pin resisting application of an upward force applied to the guide.

3. A stapler according to claim 1, wherein the elongated member receiving region of the guide has a U-shaped portion adapted to straddle the elongated member when securing the elongated member to the workpiece with said staples.

4. A stapler according to claim 1, wherein the elongated member receiving region comprises a recess notch and lateral elements flanking said recess notch.

5. A stapler according to claim 4, wherein the recess notch is configured to provide clearance to the elongated member and the lateral elements flanking the recess notch are configured to surround partially the elongated member.

6. A stapler according to claim 4, wherein the recess notch is shaped to substantially mate with a cross-section of the elongated member.

7. A stapler according to claim 1, wherein the guide comprises a gear portion having a plurality of teeth located on a circumference of the gear portion and a hole located substantially at a center of the gear portion, the hole configured to fit in a first post provided in the housing so as to allow the guide to pivot around an axis defined by said first post.

8. A stapler according to claim 7, further comprising a dial operatively connected to the guide to rotate the guide.

9. A stapler according to claim 8, wherein the dial has a disc-like configuration and has a plurality of teeth located on a portion of a circumference of the dial and a plurality of ridges located on another portion of the circumference of the dial.

10. A stapler according to claim 9, wherein the dial has a hole located substantially at a center of the dial, the hole configured to fit in a second post provided in the housing so as to allow the dial to rotate around an axis defined by the second post.

11. A stapler according to claim 10, wherein when the guide is mounted on the first post and the dial is mounted on the second post, the teeth of the gear portion of the guide and the teeth of the dial mate so that rotating the dial around the second post pivots the guide around the first post.

12. A stapler according to claim 1, wherein said hand grip portion comprises an insert or cover, and further comprising:

a trigger lever pivotally mounted to said housing for firing said stapler, said trigger lever being provided with a cover that covers at least a portion of said trigger lever, wherein said insert or cover of said hand grip portion and said trigger lever cover comprise a resilient material adapted to facilitate handling of the stapler.

13. A stapler according to claim 12, wherein said housing further includes a body portion, the body portion includes a cap portion configured to be held by an operator during operation of the stapler.

14. A stapler according to claim 13, wherein said cap portion comprises a resilient material adapted to facilitate handling of the stapler.

15. A stapler according to claim 14, wherein the resilient material is selected from the group consisting of rubber and plastic.

16. A stapler according to claim 12, wherein the resilient material is selected from the group consisting of rubber and plastic.

17. A stapler according to claim 1, wherein the guide is configured to pivot about an axis that is parallel to an axis of the staple feed track.

* * * * *